US005398511A

United States Patent [19]

Inaguchi et al.

[11] Patent Number: 5,398,511

[45] Date of Patent: Mar. 21, 1995

[54] REGENERATIVE REFRIGERATOR

[75] Inventors: Takashi Inaguchi; Masashi Nagao; Hideto Yoshimura; Kazuki Moritsu; Takahiro Matsumoto; Shuuichi Nakagawa, all of Hyogo, Japan

[73] Assignee: Mitsubishi Denki Kabushiki Kaisha, Tokyo, Japan

[21] Appl. No.: 19,580

[22] Filed: Feb. 18, 1993

[30] Foreign Application Priority Data

Mar. 30, 1992 [JP] Japan ..... 4-073715
Aug. 31, 1992 [JP] Japan ..... 4-231064

[51] Int. Cl.[6] ..... F25B 9/02
[52] U.S. Cl. ..... 62/6
[58] Field of Search ..... 62/6

[56] References Cited

U.S. PATENT DOCUMENTS 4,761,963 8/1988 Kiese ..... 62/6 X
4,862,694 9/1989 Crunkleton et al. ..... 62/6
5,099,650 3/1992 Crunkleton ..... 62/6
5,144,805 9/1992 Nagao et al. ..... 62/6

FOREIGN PATENT DOCUMENTS 46-30433 9/1971 Japan .

*Primary Examiner*—William E. Tapolcai
*Attorney, Agent, or Firm*—Burns, Doane, Swecker & Mathis

[57] ABSTRACT

According to the present invention there is provided a regenerative refrigerator wherein a gas discharged from a compressor is introduced through a regenerator into a closed chamber whose internal volume changes with movement of a movable member, the movable member being disposed within a cylinder through a predetermined gap between its outer peripheral surface and the inner peripheral surface of the cylinder, and is allowed to expand therein, then is discharged again through the same route. In this regenerative refrigerator, the size, d, of the said gap is set in the range of $1/1000 \leqq d/D \leqq 1/100$ relative to the inside diameter, D, of the cylinders or a gas convection preventing member is disposed in the said gap, or seals which are in contact with the inner peripheral surface of the cylinder are provided on the outer peripheral surfaces of both end portions of the movable member.

5 Claims, 21 Drawing Sheets

REGENERATIVE REFRIGERATOR

BACKGROUND OF THE INVENTION

1. Field of the Invention

The present invention relates to an improvement of a regenerative refrigerator having a regenerator.

2. Description of the Prior Art

FIG. 1 is a sectional view of a conventional regenerative refrigerator which is disclosed, for example, in Japanese Patent Publication No. 30433/71. In the same figure, the reference numeral 1 denotes a drive head, the numeral 2 denotes a cylinder mounted to the drive head 1, and the numeral 3 denotes a movable member which is driven for reciprocation within the cylinder 2 by means of the drive head 1 through an operating rod 4. In the interior of the movable member 3 is disposed a regenerator 5 which comprises phosphor bronze meshes or lead balls for example. In the upper and lower end portions of the movable member 3 there are formed gas passages 3*a* and 3*b*, respectively, which are in communication with the regenerator 5. Numerals 6 and 7 denote first and second closed chambers enclosed with the cylinder 2 and movable member 3 and formed respectively above and below the movable member. Numeral 8 denotes a seal for isolation between the first closed chamber 6 and the second closed chamber 7. The seal 8 is mounted in the upper end portion of the movable member 3 and is adapted to move together with the movable member while contacting the inner peripheral surface of the cylinder 2. Numeral 9 denotes a gap formed between the inner peripheral surface of the cylinder 2 and the outer peripheral surface of the movable member 3; numeral 10 denotes a heat transfer portion; numeral 11 denotes an expansion unit composed of the components 2 to 10; and numerals 12 and 13 each denote a gas pipe.

The operation of such conventional regenerative refrigerator will now be described. A high-pressure gas 15, e.g. helium, which has been compressed in a compressor (not shown) and discharged flows through the gas pipe 12 into the first closed chamber 6 of the cylinder 2, then passes through the gas passage 3*a* and is introduced into the regenerator 5, where it is cooled by chillness which was stored in the regenerator in the previous cycle. This cooled gas flows through the gas passage 3*b* into the second closed chamber 7. At this time, because of the presence of the seal 8, it is only a small amount of the gas that flows into the gap 9. The gas which has thus entered the second closed chamber 7 expands there and generates chillness to cool an object to be cooled (not shown) through the heat transfer portion 10. A portion of the gas which has become expanded and pressure-reduced in the second closed chamber 7 remains in the gap 9. On the other hand with movement of the movable member 3 into the second closed chamber, the other portion of the gas again passes through the gas passage 3*b* and then passes through the regenerator 5 in the direction reverse to the previous direction while being heat-exchanged with the regenerator to cool the regenerator. The gas thus heated by such heat exchange passes through the gas passage 3*a* and reaches the first closed chamber 6, from which it is introduced as an exhaust gas 14 into the foregoing compressor through the gas pipe 13, and is again compressed therein.

Since the conventional regenerative refrigerator is constructed as above, the gas remaining in the gap 9 can move freely, so convection is apt to occur under the influence of gravity. For example, when the regenerative refrigerator is mounted at such an angle as in FIG. 2 with respect to the gravitational directions, a part of the gas remaining in the gap 9 being low in temperature and high in density shifts to the lower side of the cylinder, resulting in that the temperature becomes lower on the lower side of the cylinder than on the upper side. If the regenerative refrigerator is mounted at such an angle as in FIG. 3, a low-temperature high-density portion of the gas remaining in the gap 9 shifts to the lower portion of the cylinder.

Thus, when the regenerative refrigerator is mounted at such an angle as in FIG. 2 or FIG. 3, as compared with the case where it is mounted at such an angle as in FIG. 1, there increases the loss of heat due to convection of the gas in the gap 9, thus causing deterioration of the refrigerating performance.

SUMMARY OF THE INVENTION

In view of the foregoing, it is an object of the present invention to provide a regenerative refrigerator capable of affording good refrigerating performance without depending on its mounting angle no matter in which direction it is mounted relative to the gravitational direction.

According to the first aspect of the present invention, for achieving the above-mentioned object, there is provided a regenerative refrigerator in which the size, d, of the gap between the inner peripheral surface of the cylinder and the outer peripheral surface of the movable member is set at $1/1000 \leqq d/D \leqq 1/100$ relative to the inside diameter, D, of the cylinder.

According to the second aspect of the present inventions there is provided a regenerative refrigerator in which a convection preventing member is provided on the outer peripheral surface of the movable member or the inner peripheral surface of the cylinder.

According to the third aspect of the present inventions there is provided a regenerative refrigerator in which seals are provided on the outer peripheral surfaces of both end portions of the movable member which seals are adapted to move together with movement of the movable member while contacting the inner peripheral surface of the cylinder.

As stated above, according to the invention there is provided with the regenerative refrigerator in which the influence of a gravitational convection of the gas in the gap is reduced by suitably setting the gap size d and by means of the convection preventing member and seal which are disposed in the gap portion.

The above and further objects and novel features of the invention will more fully appear from the following detailed description when the same is read in connection with the accompanying drawing. It is to be expressly understood, however, that the drawings are for purpose of illustration only and are not intended as a definition of the limits of the invention.

DETAILED DESCRIPTION OF THE PREFERRED EMBODIMENTS

Preferred embodiments of the invention will now be described in detail referring to the accompanying drawings.

Embodiment 1

Figure 1:
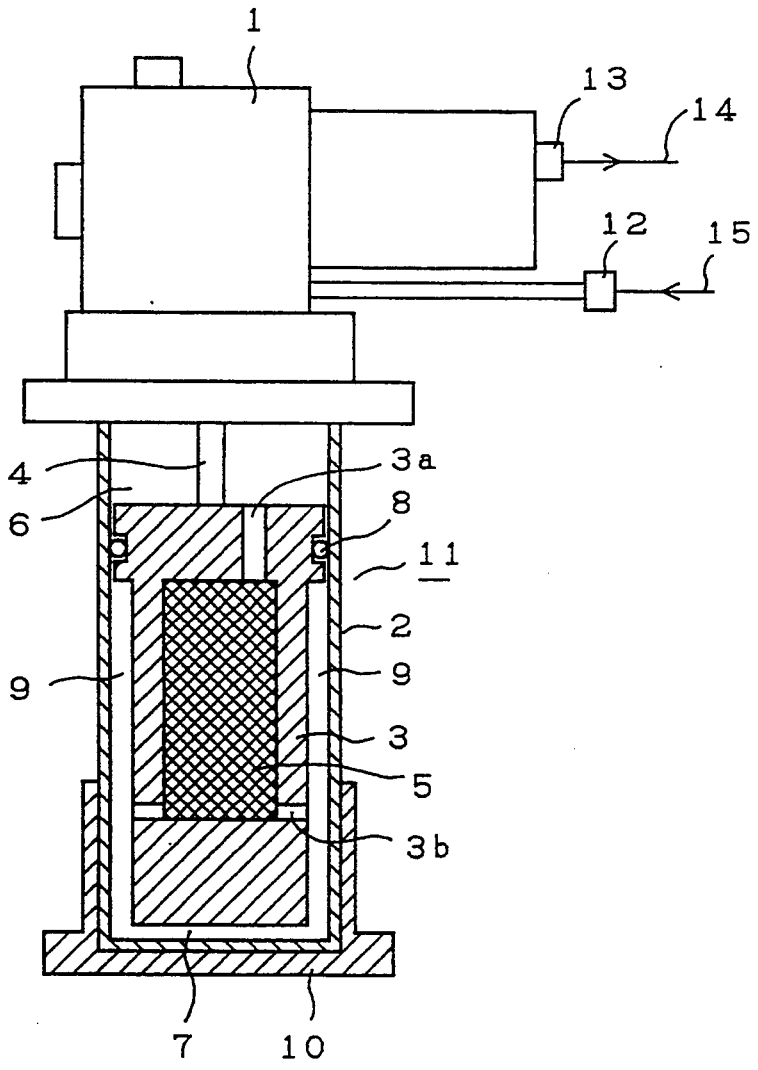
FIG. 1 (PRIOR ART)
FIG. 1 is a substantial sectional view showing a conventional regenerative refrigerator.
Figure 4:
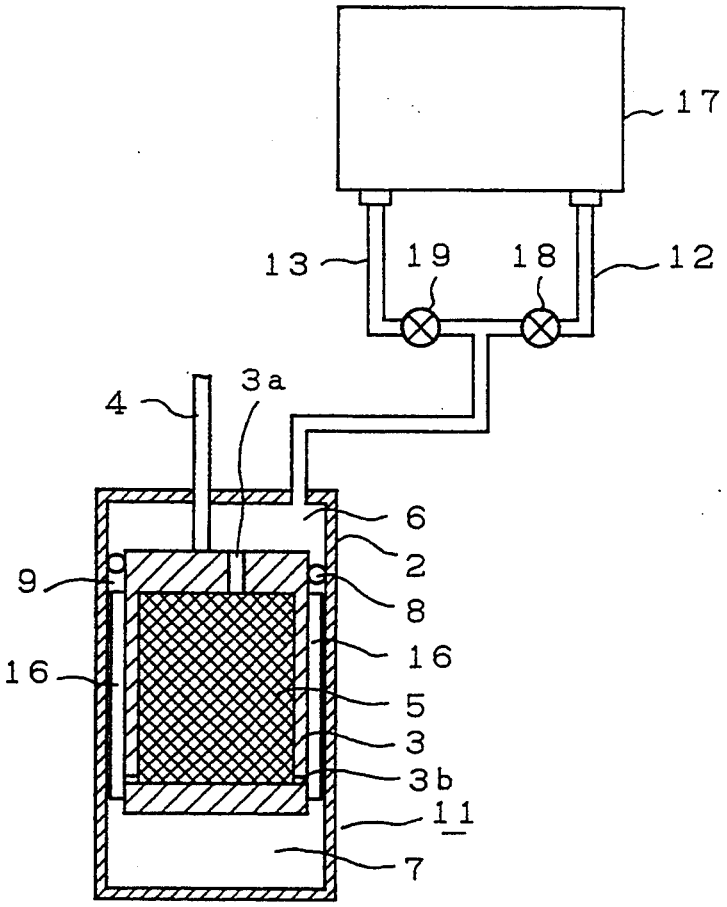
FIG. 4 is a principle sectional view showing a regenerative refrigerator according to embodiment 1 of the present invention, with a drive head not shown.
Figure 5:
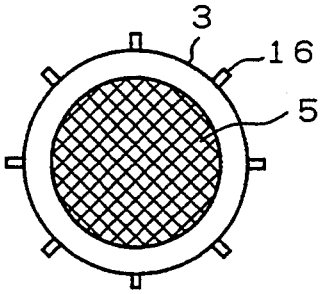
FIG. 5 is a transverse sectional view of a movable member shown in FIG. 4.

A regenerative refrigerator according to embodiment 1 of the invention will now be described with reference to FIG. 4 which is a sectional view of the refrigerator and FIG. 5 which is a transverse sectional view of a movable member shown in FIG. 4. A different point of these FIGS. 4 and 5 from FIG. 1 resides in that, as shown in FIG. 5, a plurality of plate-like convection preventing members 16 extending axially of a movable member 3 are disposed radially on the outer peripheral surface of the movable member. The numerals 17, 18 and 19 denotes a compressor, an intake valve and an exhaust valve, respectively.

Figure 2:
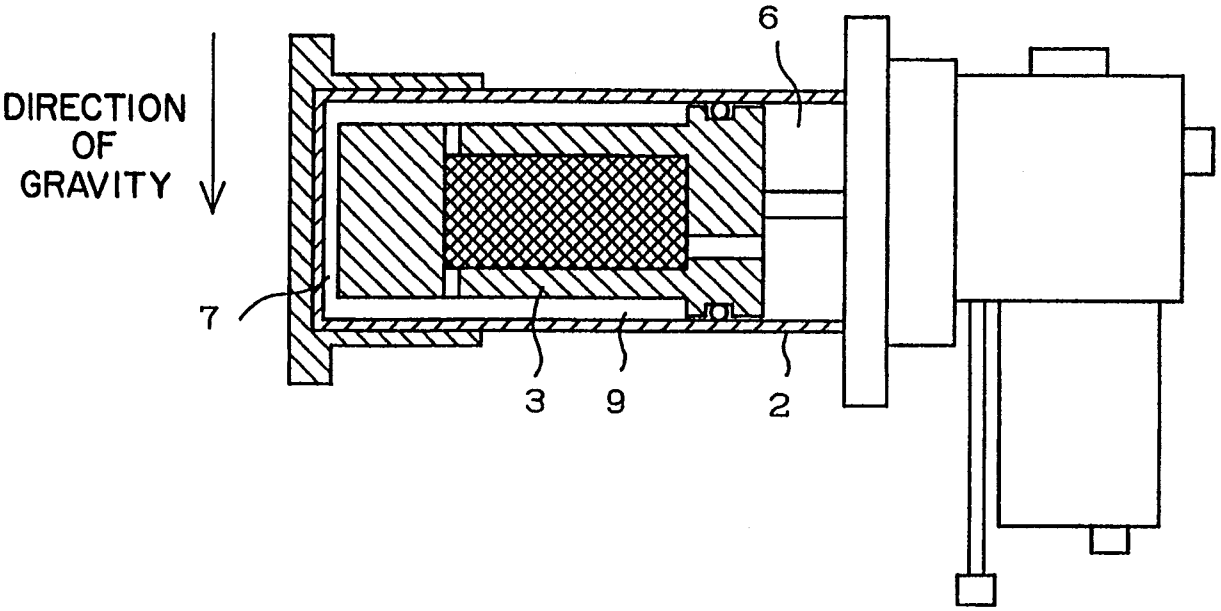
FIG. 2 is a view showing an example of a mounting angle of the regenerative refrigerator.

Description is now directed to the operation of this regenerative refrigerator. When the intake valve 18 is open, a high pressure gas, e.g. helium, which has been compressed in the compressor 17 passes through the intake valve and enters a first closed chamber 6, then flows through a gas passage 3*a* into a regenerator 5, where it is cooled by chillness which was stored in the regenerator in the previous cycle. The thus-cooled gas flows through a gas passage 3*b* into a second closed chamber 7, where it expands and generates chillness to cool an object to be cooled (not shown). A portion of the gas which has become expanded and pressure-reduced in the second closed chamber 7 remains in the gap 9. On the other hand, with movement of the movable member 3 into the second closed chamber 7, the other portion of the gas again passes through the gas passage 3*b* and then passes through the regenerator 5 in the reverse direction while being heat-exchanged with the regenerator to cool the regenerator. The gas thus heated by such heat exchange passes through the gas passage 3*a* and reaches the first closed chamber 6. The exhaust valve 19 is opened and the gas is introduced as an exhaust gas into the compressor 17 through a gas pipe 13. Again, the gas is compressed in the compressor 17. The gas remaining in the gap 9 can move in the axial direction of the movable member 3, but in the mounted state shown in FIG. 4, a heavy gas of a low temperature is present in the lower portion of the cylinder 2, so there is no gravitational convection. Even when the refrigerator is mounted at such angle as shown in FIG. 2, there will be no heat loss caused by the convection of gas in the gap 9 because a circumferential movement of the movable member 3 based on the gravity of gas in the gap 9 is prevented by the convection preventing members 16. There will be no increase in shuttle loss, either, that is a heat loss caused by the conduction of heat between the cylinder 2 and the movable member 3, because the size of the gap 9 is not set small.

Embodiment 2

Figure 6:
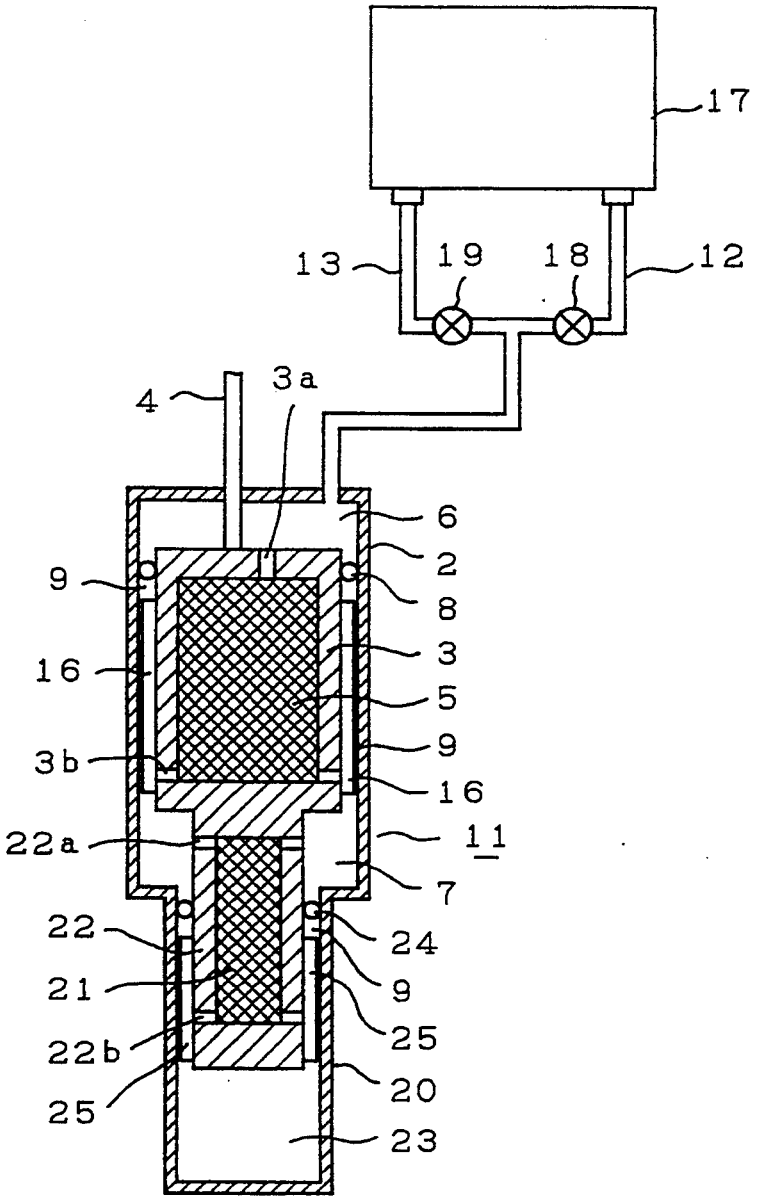
FIG. 6 is a principle sectional view showing a regenerative refrigerator according to embodiment 2 of the present invention, with a drive head not shown.

FIG. 6 is a principle sectional view of a regenerative refrigerator according to embodiment 2 of the invention, with a drive head not shown. From the embodiment shown in FIG. 4, the embodiment shown in FIG. 6 is different in that there is used an expansion unit 11 formed in two stages, more specifically, below the cylinder 2 there are provided a cylinder 20 integral with the cylinder 2 and having a capacity smaller than that of the cylinder 2; a movable member 22 positioned below and integrally with the movable member 3 and adapted to reciprocate within the cylinder 20, the movable member 22 having in the interior thereof a regenerator 21 and also having gas passages 22*a* and 22*b* which are in communication with the regenerator 21; a third closed chamber 23 defined by both the movable member 22 and the cylinder 20; and a seal 24 for isolation of the second and third closed chambers 7, 23 from each other, and that also on the outer peripheral surface of the movable member 22 there are provided a plurality of plate-like convection preventing members 25 radially. Also in this embodiment 2 there are obtained the same function and effect as in the previous embodiment 1. As to the operation, an explanation thereof is here omitted because it is the same as in the previous description.

Embodiment 3

Figure 7:
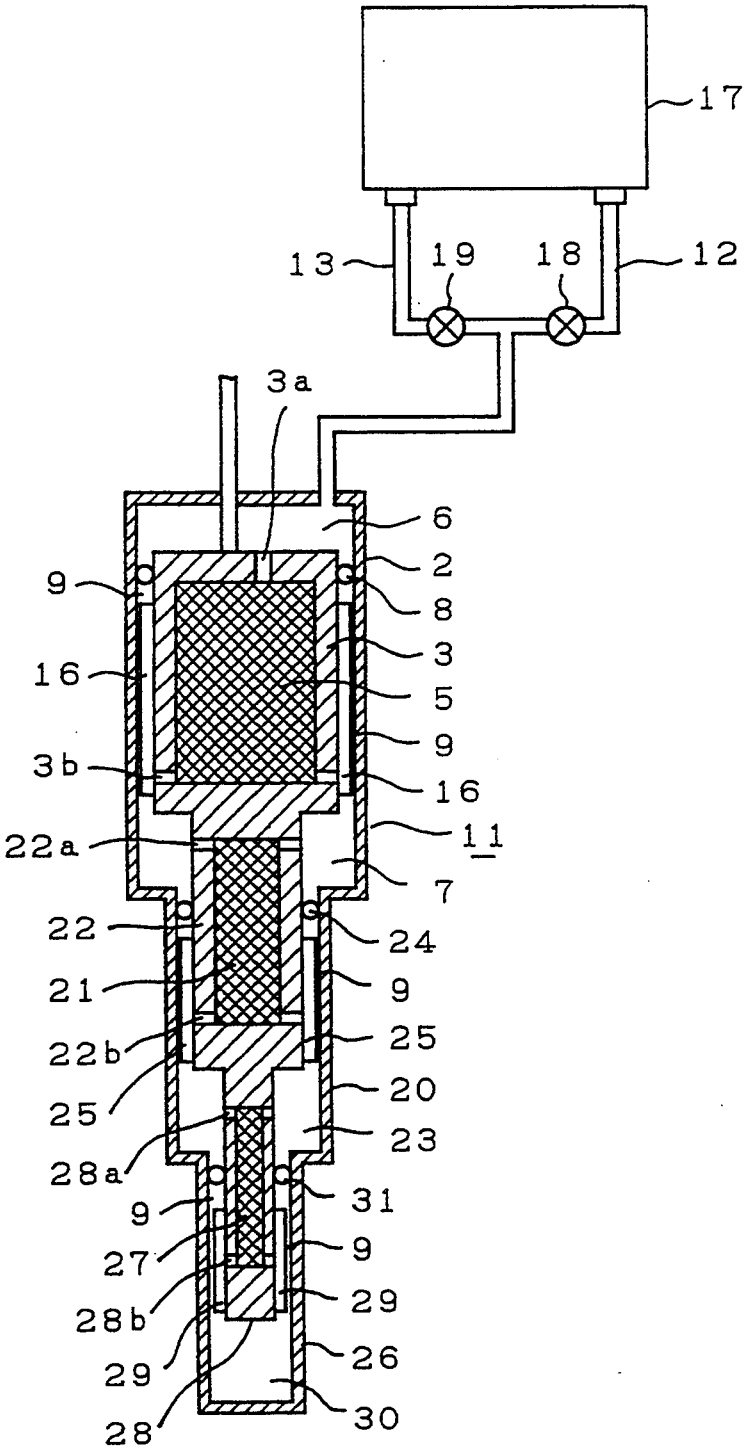
FIG. 7 is a principle sectional view showing a regenerative refrigerator according to embodiment 3 of the inventions with a drive head not shown.

FIG. 7 is a principle sectional view of a regenerative refrigerator according to embodiment 3 of the invention, with a drive head not shown. From the embodiment shown in FIG. 6, the embodiment shown in shown in FIG. 7 is different in that, as shown in FIG. 7, there is used an expansion unit 11 formed in three stages, more specifically, below the second-stage cylinder 20 there are provided a cylinder 26 integral with the cylinder 20 and having a capacity smaller than that of the cylinder 20; a movable member 28 disposed below and integrally with the movable member 22, the movable member 28 having in the interior thereof a regenerator 27 and also having gas passages 28*a* and 28*b* which are in communication with the regenerator 27; a fourth closed chamber 30 defined by both the movable member 28 and the cylinder 26; and a seal 31 for isolation of the third and fourth closed chambers 23, 30 from each other, and that also on the outer peripheral surface of the movable member 28 there are provided a plurality of plate-like convection preventing members 29 radially. Also in this embodiment there are obtained the same function and effect as in the previous embodiments. As to the operation, an explanation thereof is here omitted because it is the same as in the previous embodiments.

Embodiment 4

Figure 3:
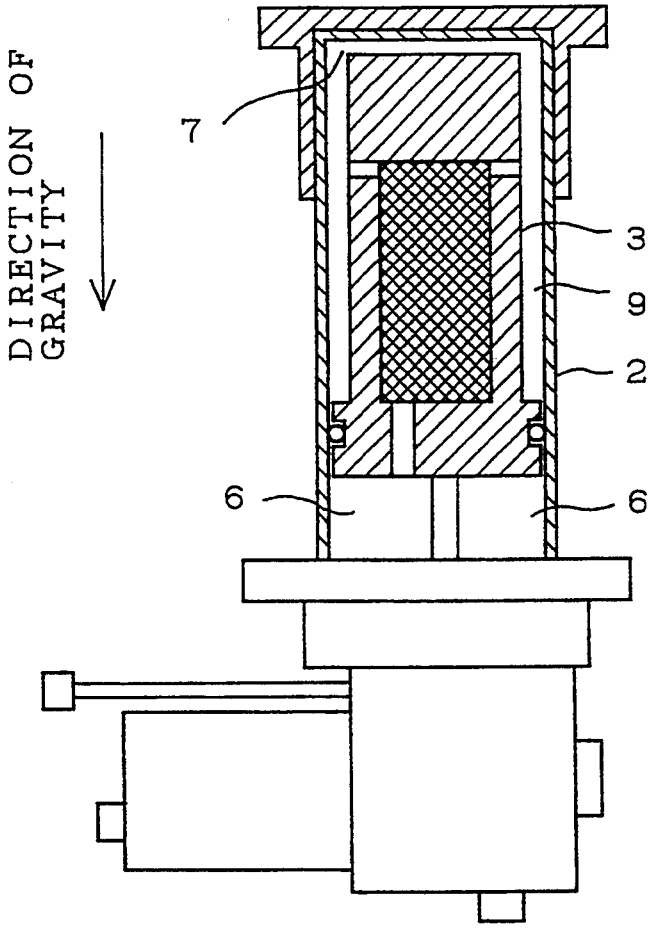
FIG. 3 is a view showing another example of a mounting angle of the regenerative refrigerator.
Figure 8:
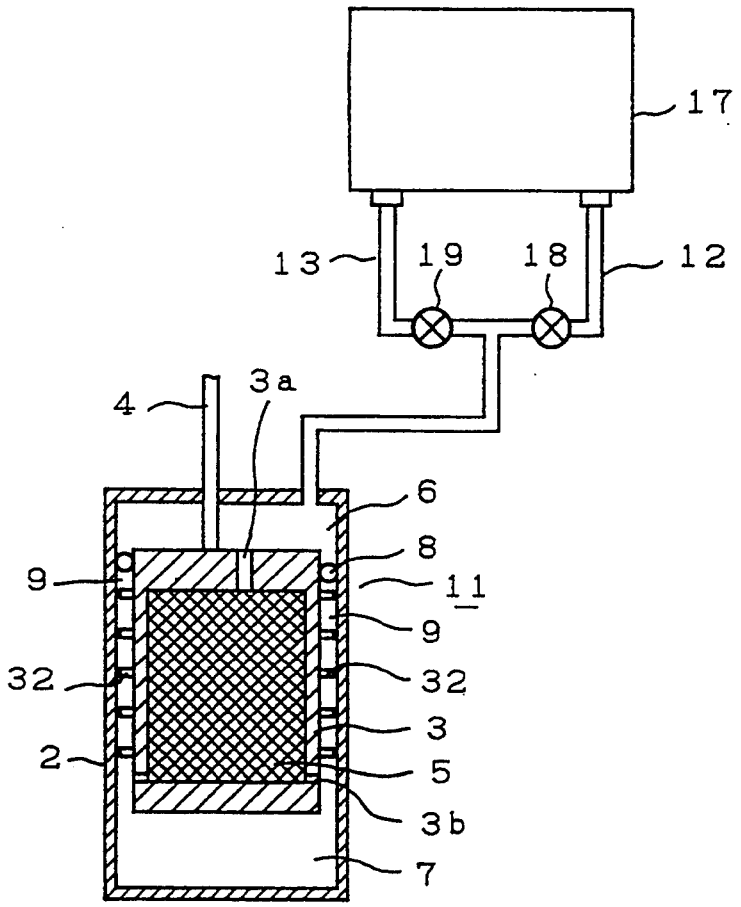
FIG. 8 is a principle sectional view showing a regenerative refrigerator according to embodiment 4 of the invention, with a drive head not shown.

FIG. 8 is a sectional view of a regenerative refrigerator according to embodiment 4 of the invention, with a drive head not shown. From the embodiment shown in FIG. 4, the embodiment shown in FIG. 8 is different in that there are used a plurality of ring-like convection preventing members 32, which are provided on the outer peripheral surface of the movable member 3 at predetermined intervals in the axial direction of the movable member to prevent the gas in the gap 9 from moving in the axial direction. According to this embodiment 4, even when the regenerative refrigerator is mounted at such angle as shown in FIG. 3, the axial movement of the movable member 3 based on the gravity of gas in the gap 9 is prevented by the convection preventing members 32, so there is no heat loss caused by the convection of gas in the gap 9. There will be no increase in shuttle loss, either, that is a heat loss caused by the conduction of heat between the cylinder 2 and the movable member 3, because the size of the gap 9 is not set small.

Embodiment 5

Figure 9:
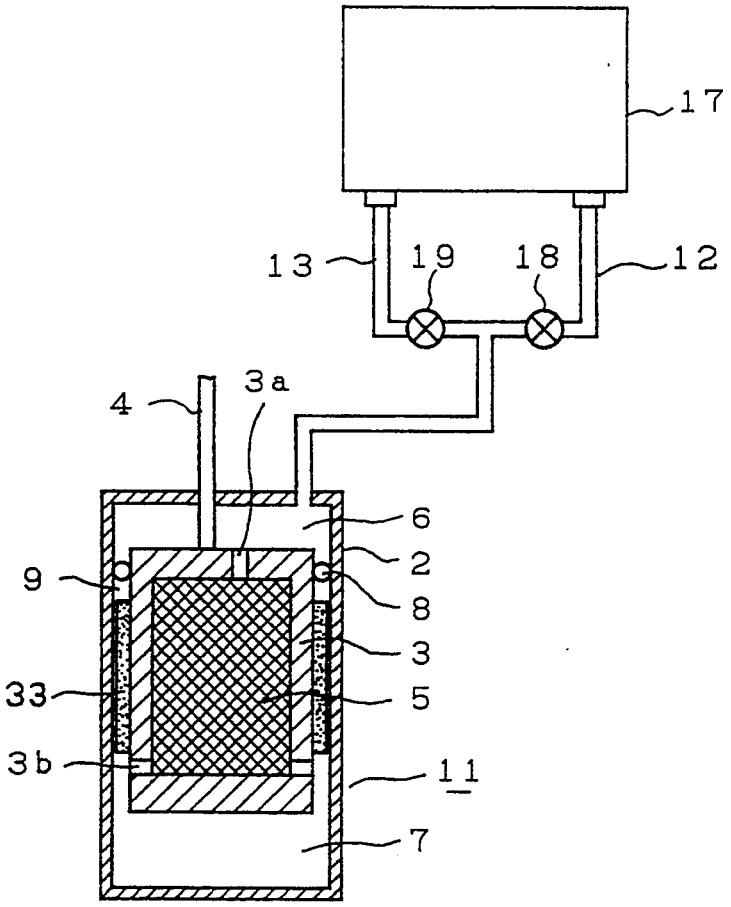
FIG. 9 is a principle sectional view showing a regenerative refrigerator according to embodiment 5 of the invention, with a drive head not shown.
Figure 10:
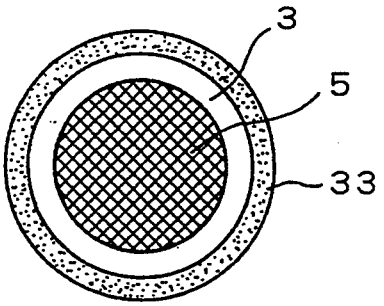
FIG. 10 is a transverse sectional view of a movable member shown in FIG. 9.

FIGS. 9 and 10 illustrate a regenerative refrigerator according to embodiment 5 of the invention, of which FIG. 9 is a sectional view thereof with a drive head not shown, and FIG. 10 is a transverse sectional view of a movable member shown in FIG. 9. From the embodiment shown in FIG. 4, the embodiment shown in FIGS. 9 and 10 is different in that a cylindrical convection preventing member 33 is provided on the outer peripheral surface of the movable member 3 and it is formed using a material poor in thermal conductivity such as polystyrene foam for example and that the size d of the gap 9 is set small, to prevent the convection of gas in the gap 9. In the case where the said gas is helium and the convection preventing member 33 is formed of polystyrene foam, the thermal conductivity of helium is $0.5\times10^{-1}$ w/m-k, while that of polystyrene foam is $0.6\times10^{-2}$, at a pressure of 2.00 Mpa and a temperature of 50K, so the shuttle loss decreases to 1/10. Thus, the heat loss based on shuttle loss also decreases, in addition to the decrease in heat loss based on the convection of gas.

Embodiment 6

Although in the above embodiments the gas convection preventing members are provided on the outer peripheral surface of the movable member, this constitutes no limitation. According to embodiment 6 of the invention, convection preventing members are provided on the inner peripheral surface of the cylinder, whereby there are obtained the same function and effect as in the previous embodiments.

Embodiment 7

Figure 11:
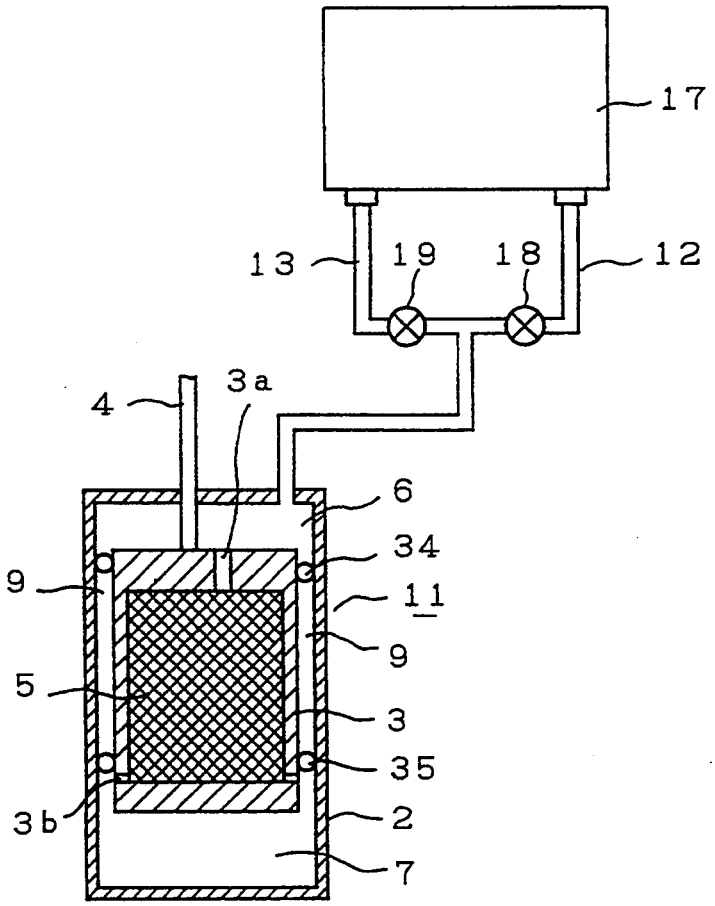
FIG. 11 is a principle Sectional view showing a regenerative refrigerator according to embodiment 6 of the invention, with a drive head not shown.

FIG. 11 is a sectional view of a regenerative refrigerator according to embodiment 7, with a drive head not shown. From the embodiment shown in FIG. 4, the embodiment shown in FIG. 7 is different in that without using any convection preventing member on the outer peripheral surface of the moving member 3, seals 34 and 35 which are in contact with the inner peripheral surface of the cylinder 3 and adapted to move together with the cylinder, are provided on the outer peripheral surfaces of both end portions of the movable member 3 to prevent the entry of gas into the gap 9 and thereby prevent heat loss caused by the convection of gas in the same gap.

Embodiment 8

Figure 12:
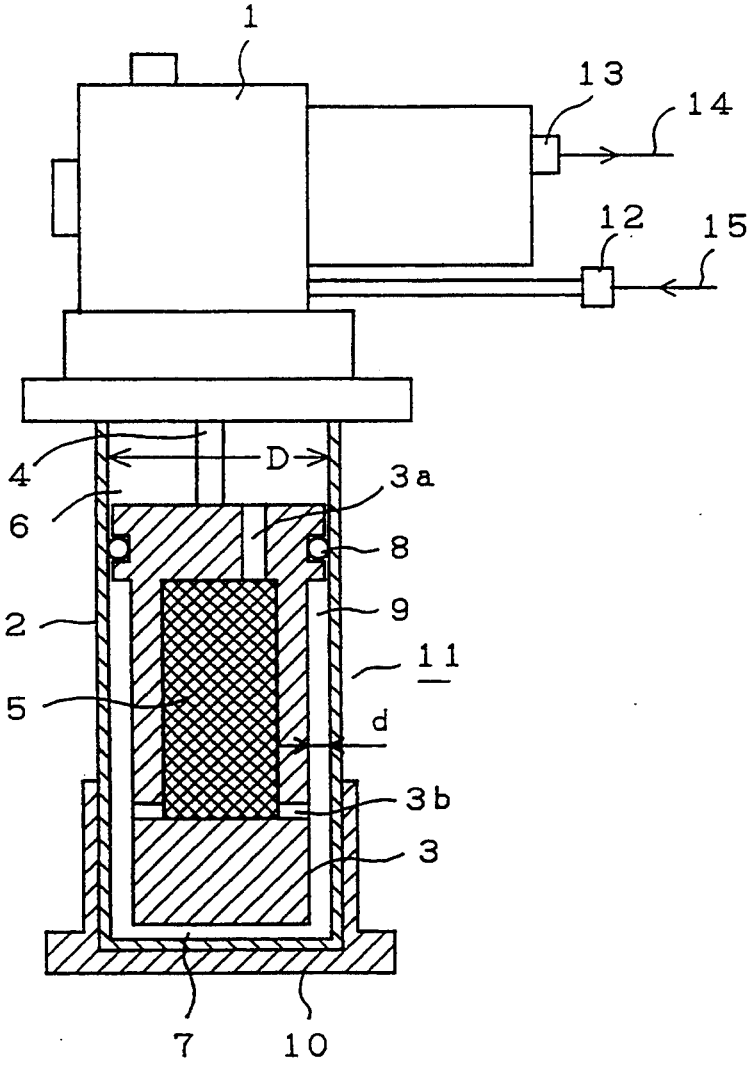
FIG. 12 is a substantial sectional view showing a regenerative refrigerator according to embodiment 7 of the invention.

FIG. 12 is a substantial sectional view of a regenerative refrigerator according to embodiment 8 of the invention. From the embodiment shown in FIG. 4, the embodiment shown in FIG. 12 is different in that a convection preventing member is not provided in the gap 9 between the outer peripheral surface of the movable member 3 and the inner peripheral surface of the cylinder 2 and that the size d of the gap 9 is set at $1/1000 \leqq d/D \leqq 1/100$ relative to the inside diameter D of the cylinder 2.

Figure 13:
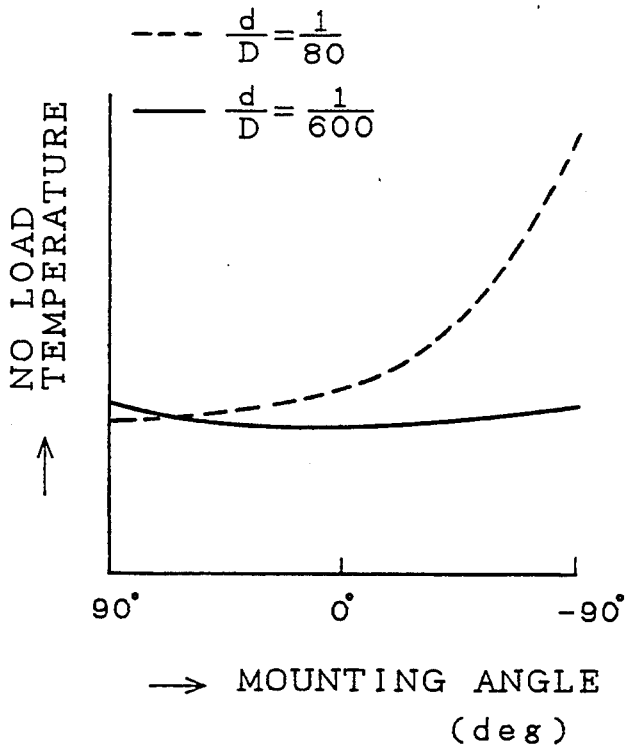
FIG. 13 is a diagram of experimental data showing a relation between regenerative refrigerator mounting angles and attained temperatures.
Figure 14:
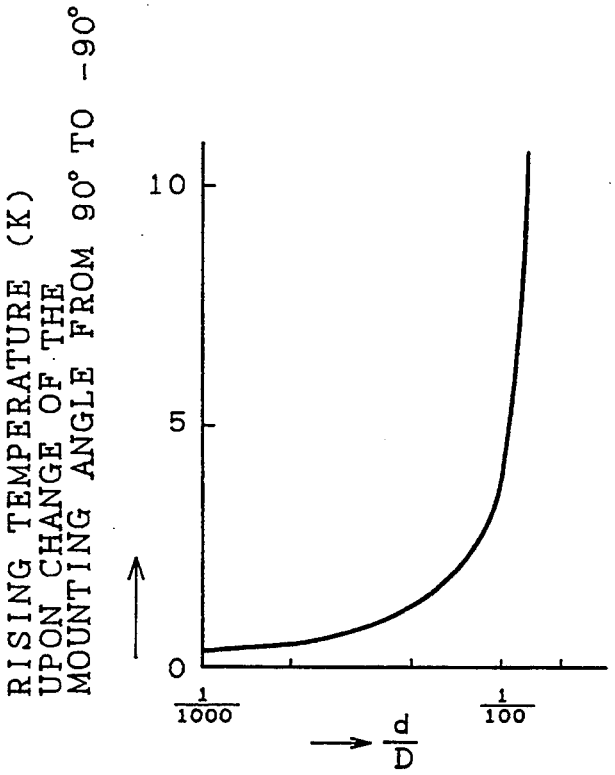
FIG. 14 is a diagram of experimental data showing a relation between d (gap size)/D (cylinder inside diameter) of the regenerative refrigerator and rising temperatures upon change of the mounting angle from 90° to −90°.

Description is now directed to the operation. As to the operation of the refrigerating cycle, an explanation thereof is here omitted because it is the same as in the previous embodiments. An explanation will be made here about the convection of gas in the gap 9 between the outer peripheral surface of the movable member 3 and the inner peripheral surface of the cylinder 2. It is assumed that such a mounting angle of the regenerative refrigerator as shown in FIG. 12 is called angle 90°, the mounting angle in FIG. 2 is called angle 0°, and the mounting angle in FIG. 3 is called angle −90°. FIG. 13 shows the result of having measured no load temperatures (the temperature of the second closed chamber 7 which is an expansion space) in the regenerative refrigerator at a change in mounting angle from 90° to −90°. When $d/D=1/80$, the attained temperature greatly varies depending on the mounting angle. When the mounting angle is 0° or −90°, there is a considerable rise in the attained temperature as compared with the case where the mounting angle is 90°. This is because when the regenerative refrigerator is mounted at the angle 0° or −90° the gas in the gap 9 induces convection more easily under gravity and this convection causes an increase of heat loss, in comparison with the case where the refrigerator is mounted at the angle 90°. On the other hand, when $d/D=1/600$, the no load temperature is scarcely dependent on the mounting angle. When the value of d/D exceeds 1/100, the rise of temperature increases suddenly, while when the d/D value is 1/100 or smaller, there is little change in the rise of temperature, as is apparent also from FIG. 14 which shows experimental data of a relation between d/D and a rising temperature (k) upon change of the mounting angle from 90° to −90°. At a d/D value below 1/1000, there arises a sudden increase in shuttle loss, resulting in increase of the no load temperature. But since d/D is set in the range of $1/1000 \leqq d/D \leqq 1/100$, there is little influence of shuttle loss and there is obtained a good refrigerating performance with little dependence on the mounting angle.

Embodiment 9

Figure 15:
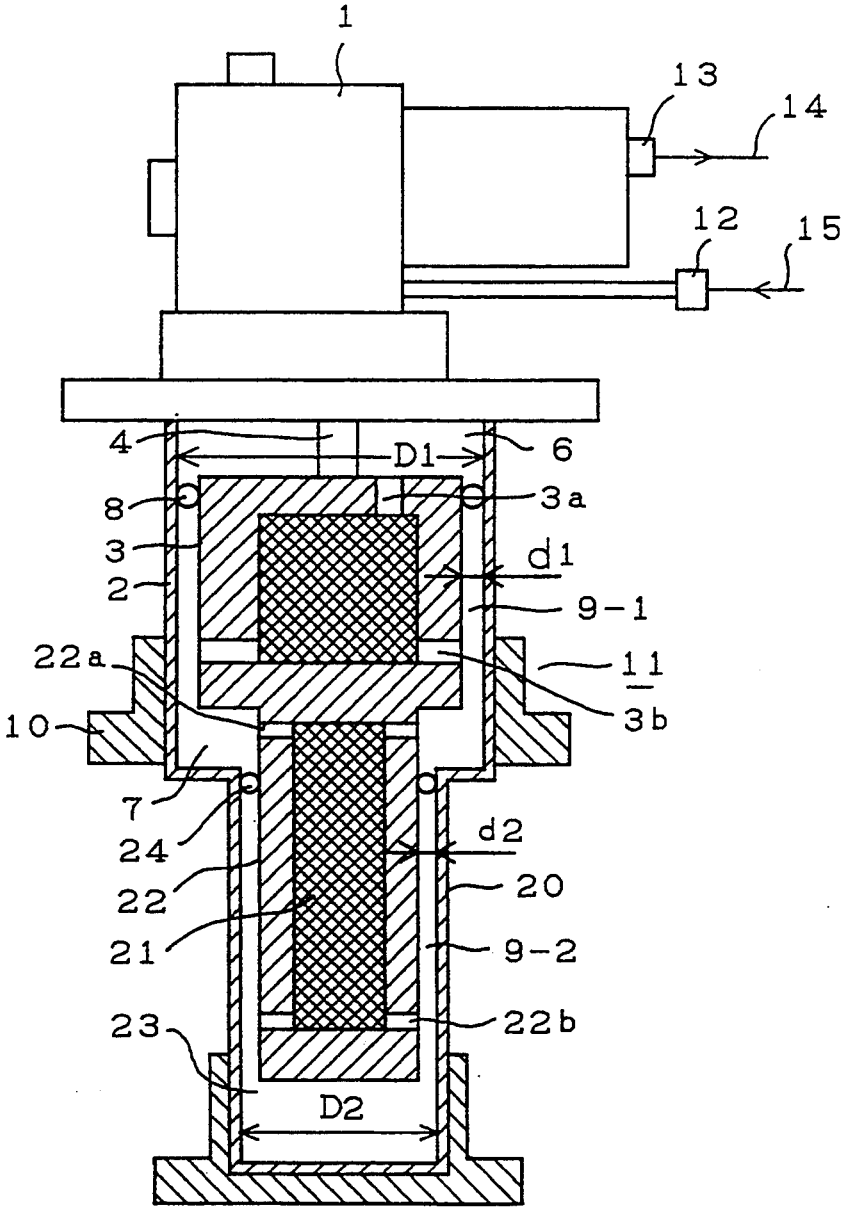
FIG. 15 is a substantial sectional view showing a regenerative refrigerator according to embodiment 9 of the invention.

FIG. 15 is a substantial so sectional view of a regenerative refrigerator according to embodiment 9 of the invention. From the embodiments shown in FIG. 12, the embodiment shown in FIG. 15 is different in that there is used an expansion unit 11 formed in two stages and that the size $d_1$ of a gap 9-1 between the outer peripheral surface of a movable member 3 and the inner peripheral surface of a cylinder 2 is set at $1/1000 \leqq d_1/D_1 \leqq 1/100$ relative to the inside diameter $D_1$ of the cylinder 2 in the first stage, while in the second stage, the size $d_2$ of a gap 9-2 between the outer peripheral surface of a movable member 22 and the inner peripheral surface of a cylinder 20 is set at $1/1000 \leqq d_2/D_2 \leqq 1/100$ relative to the inside diameter $D_2$ of the cylinder 20. There are obtained the same function and effect as in the previous embodiment. As to the operation, an explanation thereof is here omitted because is it is the same as in the previous embodiment.

Embodiment 10

Figure 16:
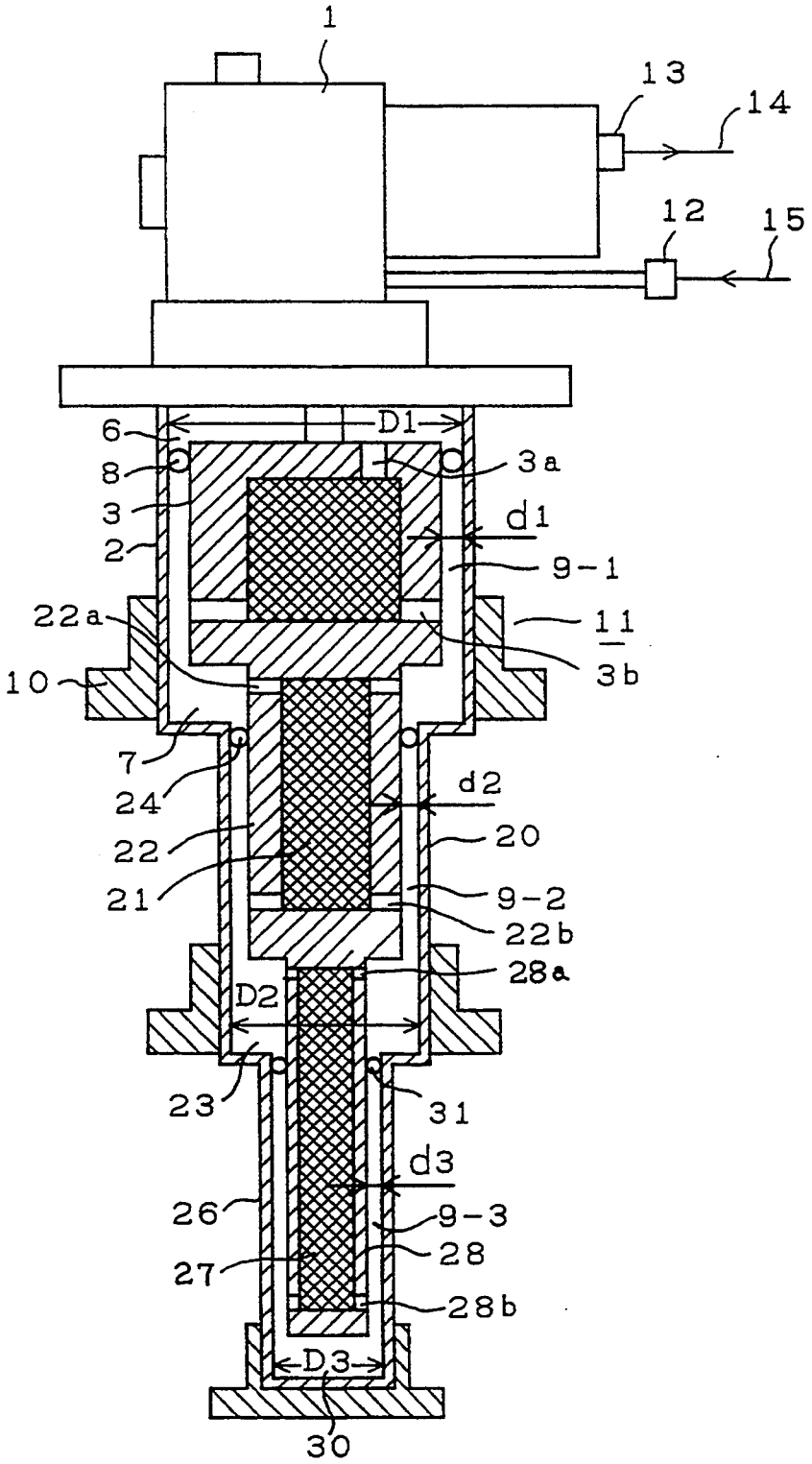
FIG. 16 is a substantial sectional view showing a regenerative refrigerator according to embodiment 10 of the invention.

FIG. 16 is a substantial sectional view of a regenerative refrigerator according to embodiment 10 of the invention. From the embodiment shown in FIG. 12, the embodiment shown in FIG. 16 is different in that there is used an expansion unit 11 formed in three stages and that, in the first stage the size $d_1$ of a gap 9-1 between the one outer peripheral surface of a movable member 3 and the inner peripheral surface of a cylinder 2 is set at $1/1000 \leqq d_1/D_1 \leqq 1/100$ relative to the inside diameter $D_1$ of the cylinder 2, while in the second stage, the size $d_2$ of a gap 9-2 between the outer peripheral surface of a movable member 22 and the inner peripheral surface of a cylinder 20 is set at $1/1000 \leqq d_2/D_2 \leqq 1/100$ relative to the inside diameter $D_2$ of the cylinder 20, and further, in the third stage, the size $d_3$ of a gap 9-3 between the outer peripheral surface of a movable member 28 and the inner peripheral surface of a cylinder 26 is set at $1/1000 \leqq d_3/D_3 \leqq 1/100$ relative to the inside diameter $D_3$ of the cylinder 26. There are obtained the same function and effect as in the previous embodiment. As to the operation, since it is the same as in the previous embodiment, an explanation thereof is here omitted.

Embodiment 11

Figure 17:
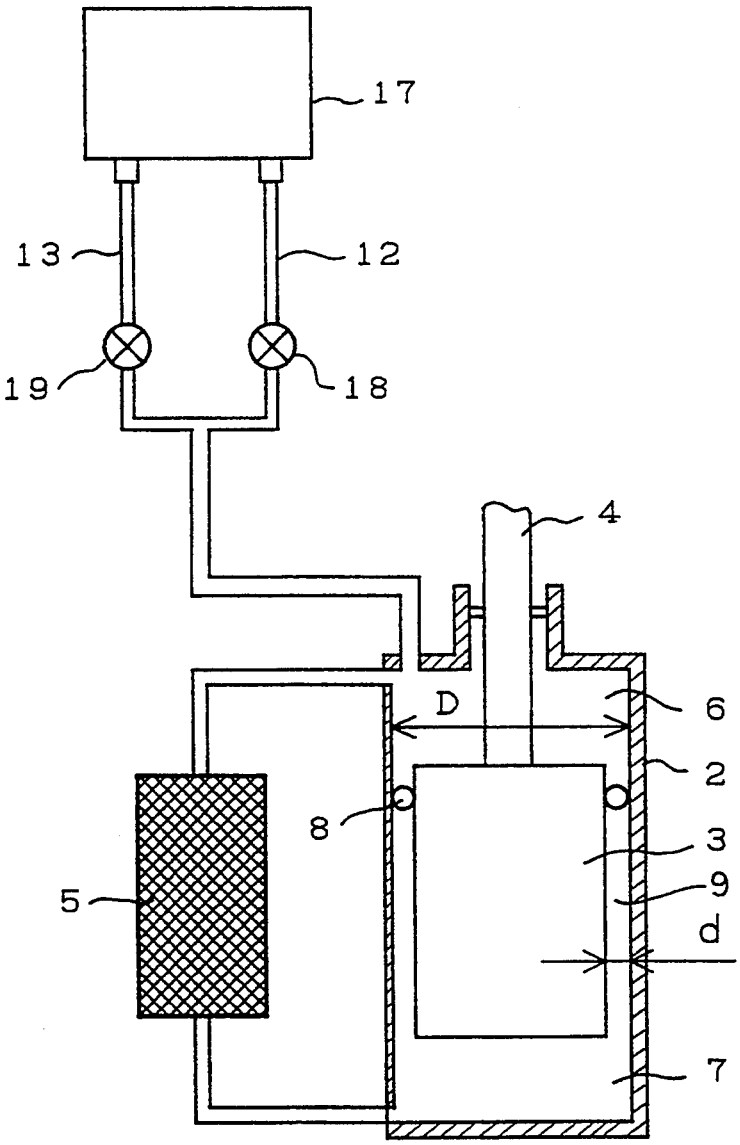
FIG. 17 is a principle sectional view showing a regenerative refrigerator according to embodiment 11 of the invention, with a drive head not shown.

FIG. 17 is a principle sectional view of a regenerative refrigerator according to embodiment 11 of the invention, with a cylinder head not shown. This embodiment is different from the embodiment of FIG. 12 in that a regenerator 5 is externally attached to a cylinder 2 and that a movable member 3 not incorporating a regenerator therein is disposed within the cylinder 2 so as to be reciprocatable through a seal 8. In this embodiment, the size d of a gap 9 is set at $1/1000 \leqq d/D \leqq 1/100$ relative to the inside diameter D of the cylinder 2, whereby there are obtained the same function and effect as in the previous embodiment.

Embodiment 12

Figure 18:
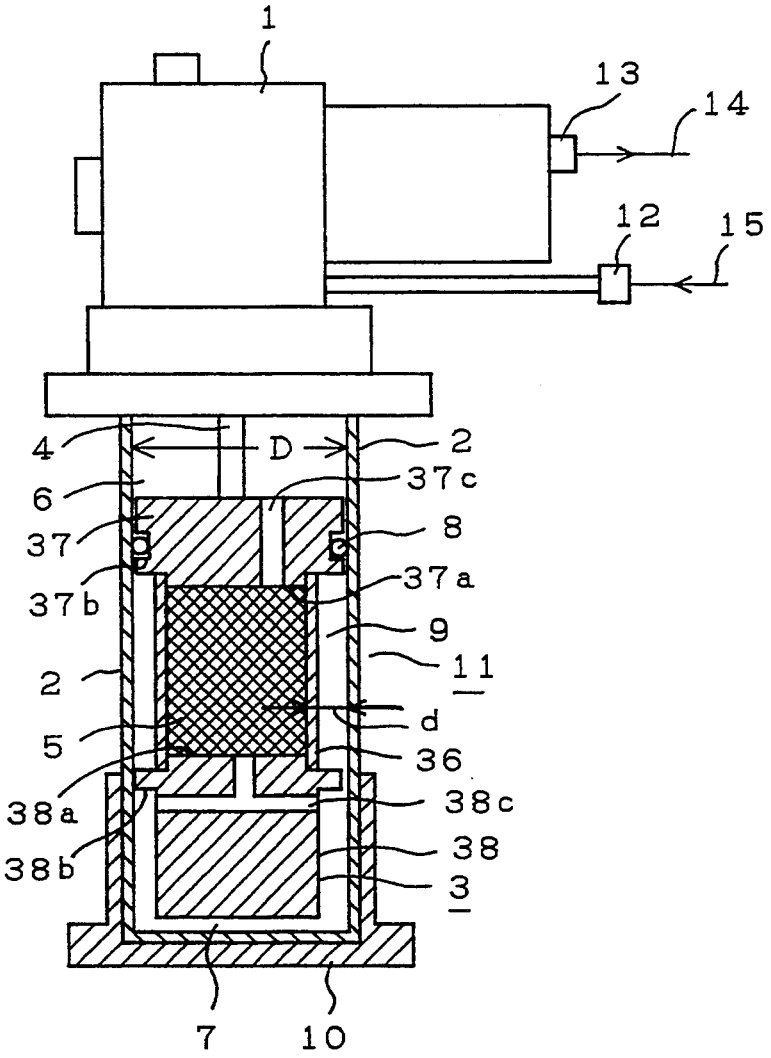
FIG. 18 is a substantial sectional view showing a regenerative refrigerator according to embodiment 12 of the invention.

FIG. 18 is a substantial sectional view of a regenerative refrigerator according to embodiment 12 of the invention. This embodiment is different from the embodiment of FIG. 12 in the following points. A movable member 3 used in this embodiment comprises a cylindrical, movable member body 36 formed of the same material as that of a cylinder 2 which is formed of stainless steel; a first cylindrical sealing member 37 having an outside diameter larger than that of the movable member body 36 and provided at the lower end thereof with a convex portion **37*a* which hermetically engages the upper portion of the movable member body 36, the first sealing member 37 being formed of such an material as a phenolic resin which has recommended sliding property; and a second cylindrical sealing member 38 having an outside diameter almost equal to that of the movable member body 36 and provided at the upper end thereof with a convex portion 38*a* which hermetically engages the lower end of the movable member body 36, the second sealing member 38 further having on its outer peripheral surface an annular convex portion 38*b* whose outside diameter is larger than that of the movable member body 36, the second sealing member 38 being formed of the aforementioned material such as a phenolic resin. Moreover, an annular groove 37*b* is formed in the outer peripheral surface of the sealing member 37, and a cap seal 8 which, for example, comprises nitrile rubber and a polytetrafluoroethylene layer formed on the outer peripheral portion of the nitrile rubber is fitted in the groove 37*b* to isolate first and second closed chambers 6, 7 from each other. Further, gas passages 37*c* and 38*c* which are in communication with a regenerator 5 are formed in the first and second sealing members 37, 38, respectively. Since the stainless steel which forms the movable member body 36 and the cylinder 2 does not exhibit a water absorbing action, there is no dimensional change caused by the absorption of water during manufacture. Also during operations even upon change of the temperature, e.g. temperature drop, since the thermal expansion coefficient of the movable member body 36 and that of the cylinder 2 are the same, the size $d_1$ of a gap 9 does not change and its relation of $1/1000 \leqq d/D \leqq 1/100$ to the inside diameter D of the cylinder 2** is maintained, whereby the heat loss is reduced and there is obtained a more satisfactory refrigerating performance. As to the operation, since it is the same as in the previous embodiment, an explanation thereof is here omitted.

Embodiment 13

Figure 19:
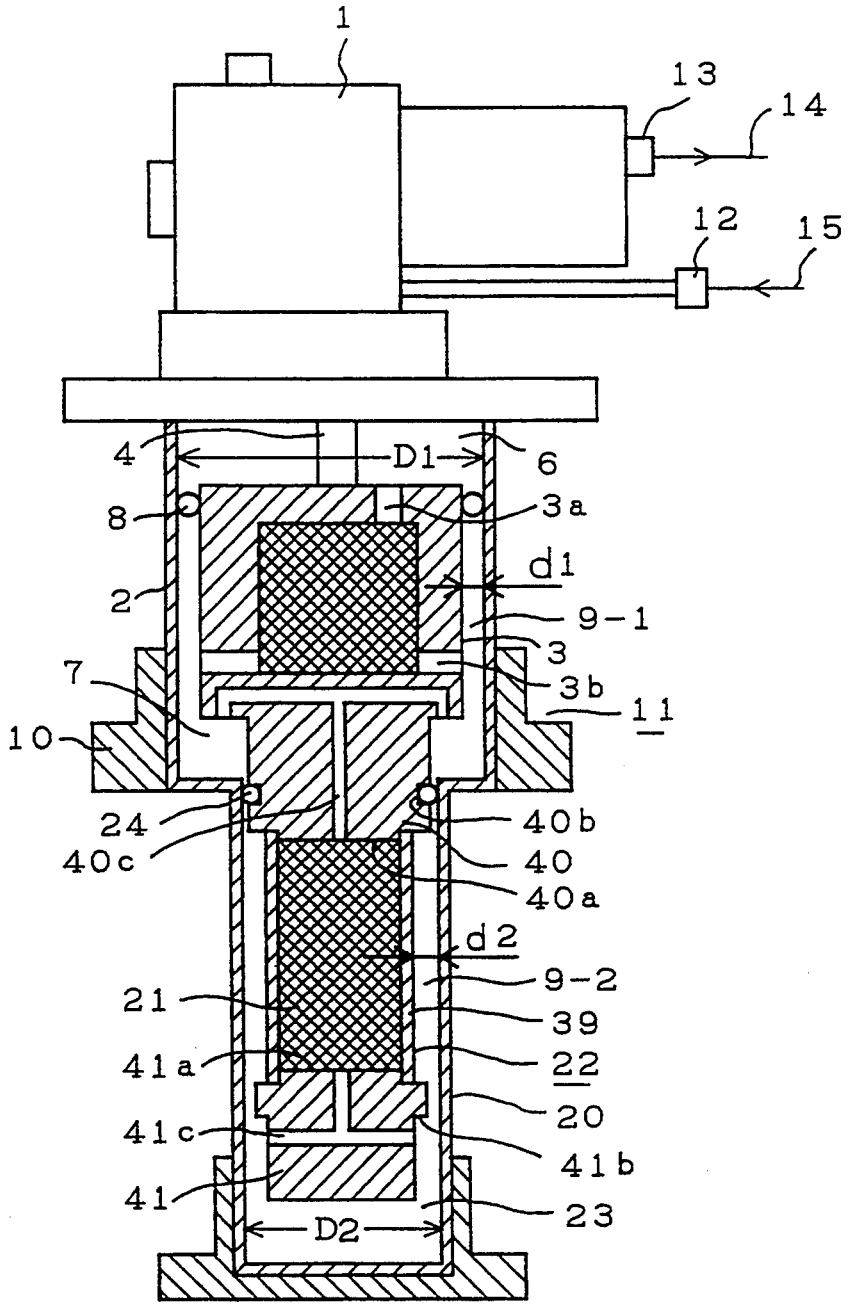
FIG. 19 is a substantial sectional view showing a regenerative refrigerator according to embodiment 13 of the invention.

FIG. 19 is a substantial sectional view of a regenerative refrigerator according to embodiment 13 of the invention. The embodiment is different from the embodiment of FIG. 15 in the following points. As the second stage movable member there is used a movable member 22 comprising a cylindrical, movable member body 39 formed of the same material as that of a cylinder 20 which is formed of stainless steel; a first cylindrical sealing member 40 formed integrally with the lower end of the first stage movable member 3, having an outside diameter larger than that of the movable member body 39 and provided at the lower end thereof with a convex portion 40*a* which hermetically engages the upper portion of the movable member body 39, the first sealing member 40 being formed of such an insulating material as a phenolic resin which is a bad conductor of heat; and a second cylindrical sealing member 41 having an outside diameter almost equal to that of the movable member body 39 and provided at the upper end thereof with a convex portion 41*a* which hermetically engages the lower end of the movable member body 39, the second sealing member 41 further having on its outer peripheral surface an annular convex portion 41*b* whose outside diameter is larger than that of the movable member body 39, and the second sealing member 41 being formed of the aforesaid insulating material such as a phenolic resin. Moreover, an annular groove 40*b* is formed in the outer peripheral surface of the sealing member 40, and a piston ring 24 formed of, for example, polytetrafluoroethylene with glass incorporated therein, is fitted in the groove 40*b* to isolate second and third closed chambers 7, 23 from each other. Further, gas passages 40*c* and 41*c* which are in communication with a regenerator 21 are formed in the first and second sealing members 40, 41, respectively. As in the previous embodiment, therefore, the movable member body 39 and the cylinder 20 undergo no dimensional change caused by the absorption of water. Even when the temperature changes, since both components are the same in thermal expansion coefficient, the size $d_2$ of a gap 9-2 does not change and its relation of $1/1000 \leqq d_2/D_2 \leqq 1/100$ to the inside diameter $D_2$ of the cylinder 20 is maintained, whereby the heat loss is reduced, thus affording a more satisfactory refrigerating performance. An explanation of the operation is here omitted because of the same operation as in the previous embodiment.

Embodiment 14

Figure 20:
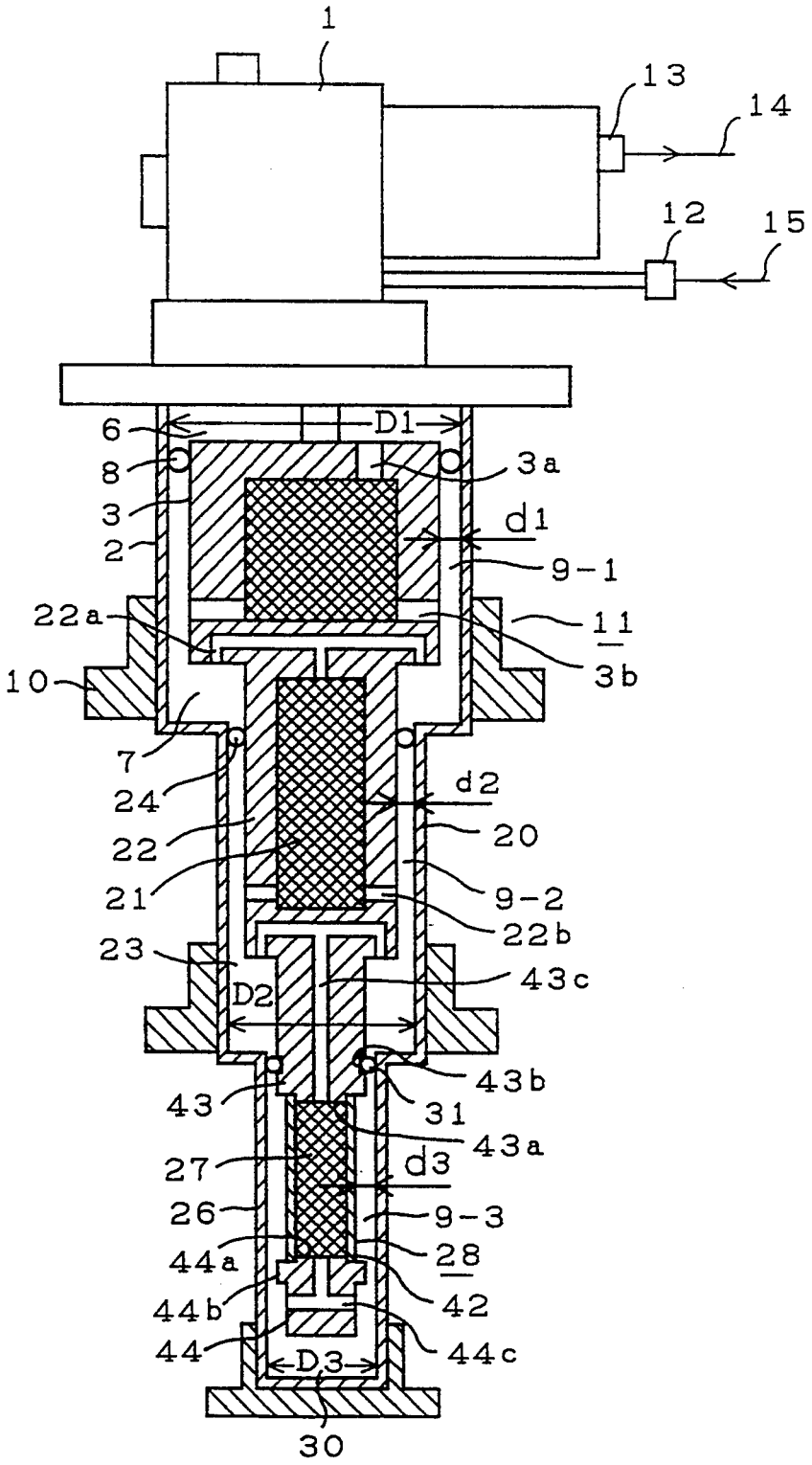
FIG. 20 is a substantial sectional view showing a regenerative refrigerator according to embodiment 14 of the invention.

FIG. 20 is a sectional view of a regenerative refrigerator according to embodiment 14 of the invention. This embodiment is different from the embodiment of FIG. 16 in the following points. As the third stage movable member there is used a movable member 28 comprising a cylindrical, movable member body 42 formed of the same material as that of a cylinder 26 which is formed of stainless steel; a first cylindrical sealing member 43 formed integrally with the lower end of the second stage movable member 22 and having an outside diameter larger than that of the movable member body 42, also having at the lower end thereof convex portion 43*a* which hermetically engages the upper portion of the movable member body 42, the first sealing member 43 being formed of such an insulating material as a phenolic resin which is a bad conductor of heat; and a second cylindrical sealing member 44 having an outside diameter almost equal to that of the movable member body 42 and provided at the upper end thereof with a convex portion 44*a* which hermetically engages the lower end of the movable member body 42, further having on the outer peripheral surface thereof an annular convex portion 44*b* whose outside diameter is larger than that of the movable member body 42, the second sealing member 44 being formed of the aforesaid insulating material such as a phenolic resin. Moreover, an annular groove 43*b* is formed in the outer peripheral surface of the sealing member 43, and a piston ring 31 formed of, for example, polytetrafluoroethylene with glass incorporated therein is fitted in the groove 43*b* to isolate third and fourth closed chambers 23, 30 from each other. Further, gas passages 43*c* and 44*c* which are in communication with a regenerator 27 are formed in the first and second sealing members 43, 44, respectively. As in the previous embodiment, therefore, the movable member body 42 and the cylinder 26 do not undergo any dimensional change caused by the absorption of water. Even upon change of the temperature, since both components are the same in thermal expansion coefficient, the size $d_3$ of a gap 9-3 does not change and its relation of $1/1000 \leqq d_3/D_3 \leqq 1/100$ to the inside diameter $D_3$ of the cylinder 26 is maintained, whereby the heat loss is reduced, thus affording a more satisfactory refrigerating performance. As to the operations since it is the same as in the previous embodiment, an explanation thereof is here omitted.

Embodiment 15

Although in the foregoing embodiment 13 the second stage movable member 22 is composed of the movable member body 39 formed of the same stainless steel as that of the cylinder 20 and the first and second sealing members 40, 41, the first stage movable member 3 may also be constructed of the movable member body and the first and second sealing members, like the second stage movable member 22. In this case, a more satisfactory refrigerating performance is obtained.

Embodiment 16

Although in the foregoing embodiment 14 the third stage movable member 28 is composed of the movable member body 42 formed of the same stainless steel as that of the cylinder 26 and the first and second sealing members 43, 44, the second stage movable member 22 or both the first and second stage movable members 3, 22 may also be constructed of the movable member body and the first and second sealing members, like the third stage movable member 28. In this case there is obtained a more satisfactory refrigerating performance.

Embodiment 17

Although in each of the above embodiments 12 to 16 the movable member body is formed of stainless steel, this constitutes no limitation if only the material of the movable member body and that of the cylinder are of the same thermal expansion coefficient. For example, the movable member body and the cylinder may be formed of phosphor bronze, and also in this case there is obtained the same effect as in the embodiments just referred to above.

Embodiment 18

Although in each of the above embodiments 12 to 17 the movable member body and the cylinder are formed using the same thermal expansion coefficient material and the first and second sealing members which hermetically engage both ends of the movable member body are formed using an insulating material, the first and second sealing members may also be formed using the same material as that of the movable member and cylinder, e.g. stainless steel or phosphor bronze, and the surface of the movable member body opposed to the cylinder may be coated with polyimide or polytetrafluoroethylene (PTFE). Also in this case there is obtained the same effect as in the embodiments just referred to above.

Embodiment 19

The movable member body and the first and second sealing members may be formed integrally using stainless steel or phosphor bronze, and also in this case there is obtained the same effect as in the previous embodiment.

Embodiment 20

Figure 21:
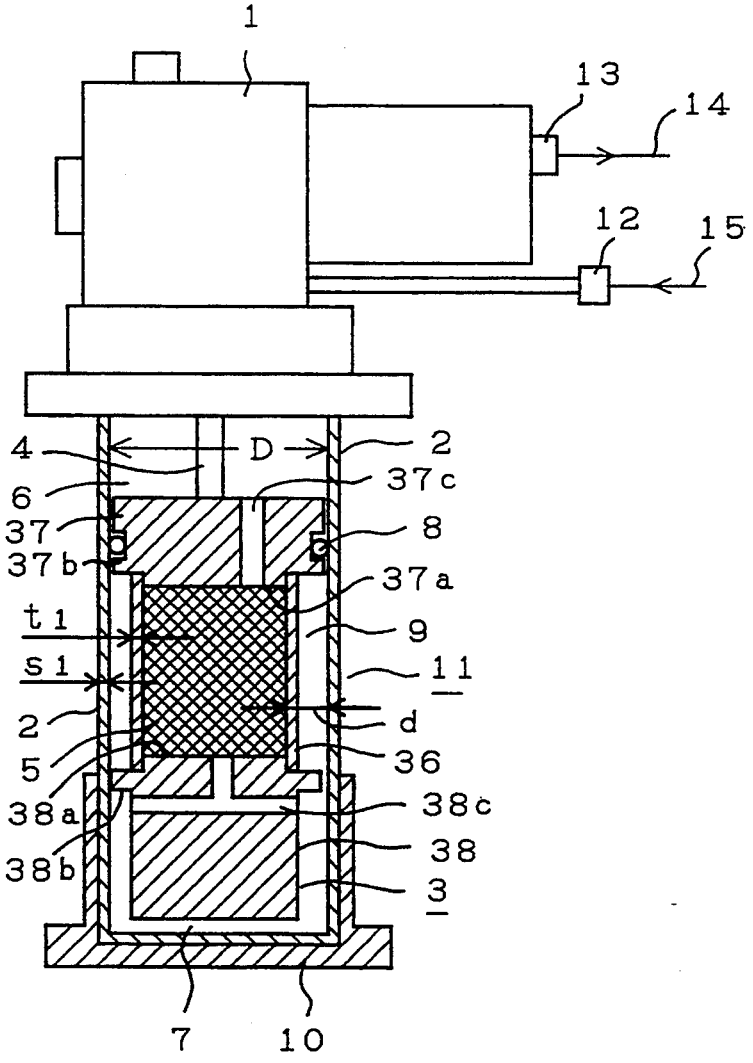
FIG. 21 is a substantial sectional view showing a regenerative refrigerator according to embodiment 20 of the invention.

FIG. 21 is a substantial sectional view of a regenerative refrigerator according to embodiment 20 of the invention. This embodiment is different from the embodiment of FIG. 18 in that the wall thickness to of the movable member body 36 is set about the same as or smaller than the wall thickness $S_1$ of the cylinder 2. The amount of heat transmitted to the movable member body 36 is suppressed about the same as or smaller than that transmitted to the cylinder 2, and since part of the movable member 3 is constituted by stainless steel, there is obtained a more satisfactory refrigerating performance without great increase in the amount of heat transmitted thereto.

Embodiment 21

Figure 22:
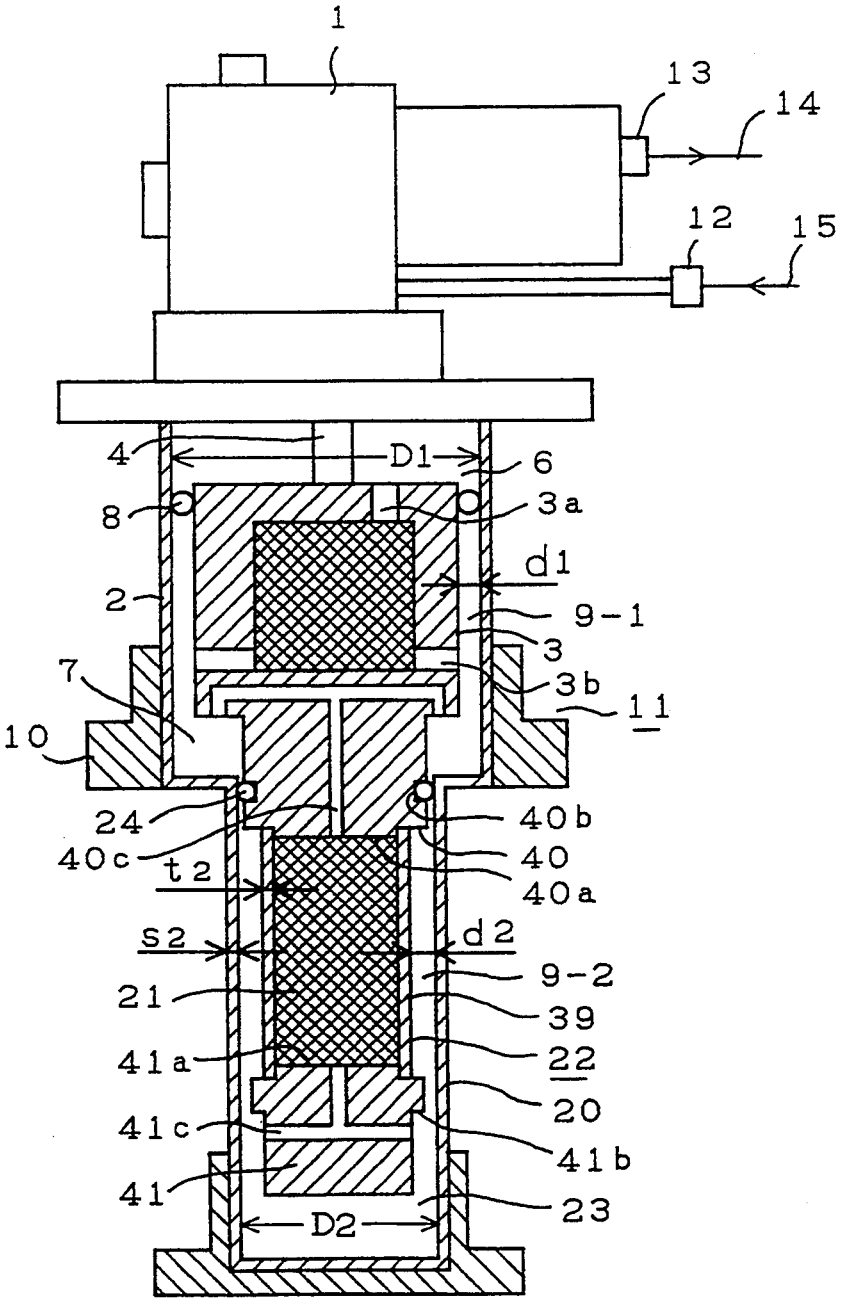
FIG. 22 is a substantial sectional view showing a regenerative refrigerator according to embodiment 21 of the invention.

FIG. 22 is a substantial sectional view of a regenerative refrigerator according to embodiment 21 of the invention. This embodiment is different from the embodiment of FIG. 19 in that the wall thickness $t_2$ of the movable member body 39 is set about the same as or smaller than the wall thickness $S_2$ of the cylinder 22. Also in this case there is obtained the same effect as in the embodiment 20.

Embodiment 22

Figure 23:
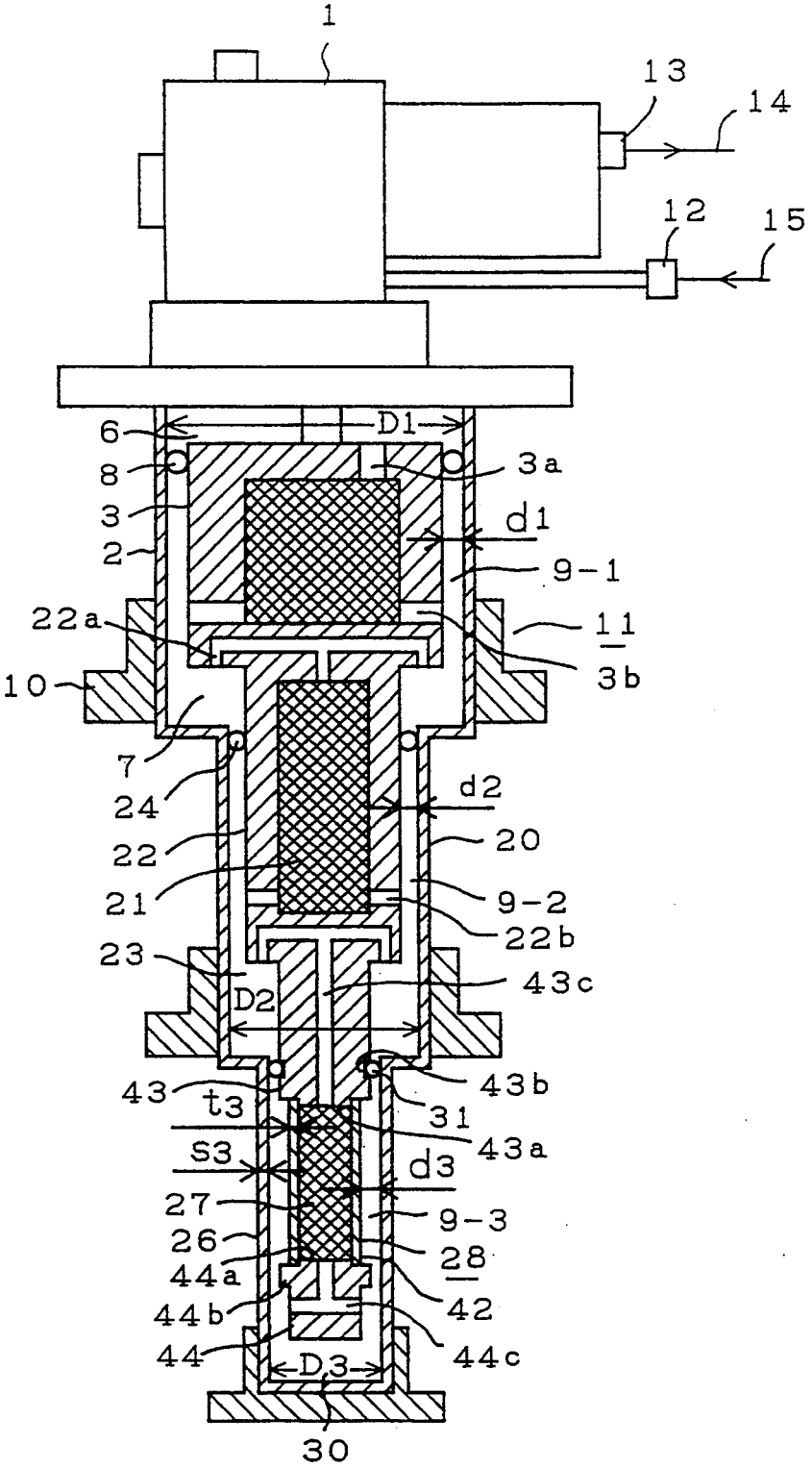
FIG. 23 is a substantial sectional view showing a regenerative refrigerator according to embodiment 22 of the invention.

FIG. 23 is a substantial sectional view of a regenerative refrigerator according to embodiment 22 of the invention. This embodiment is different from the embodiment of FIG. 20 in that the wall thickness $t_3$ of the movable member body 42 is set about the same as or smaller than the wall thickness $S_3$ of the cylinder 26. Also in this case there is obtained the same effect as in the embodiment 20.

Embodiment 23

Figure 24:
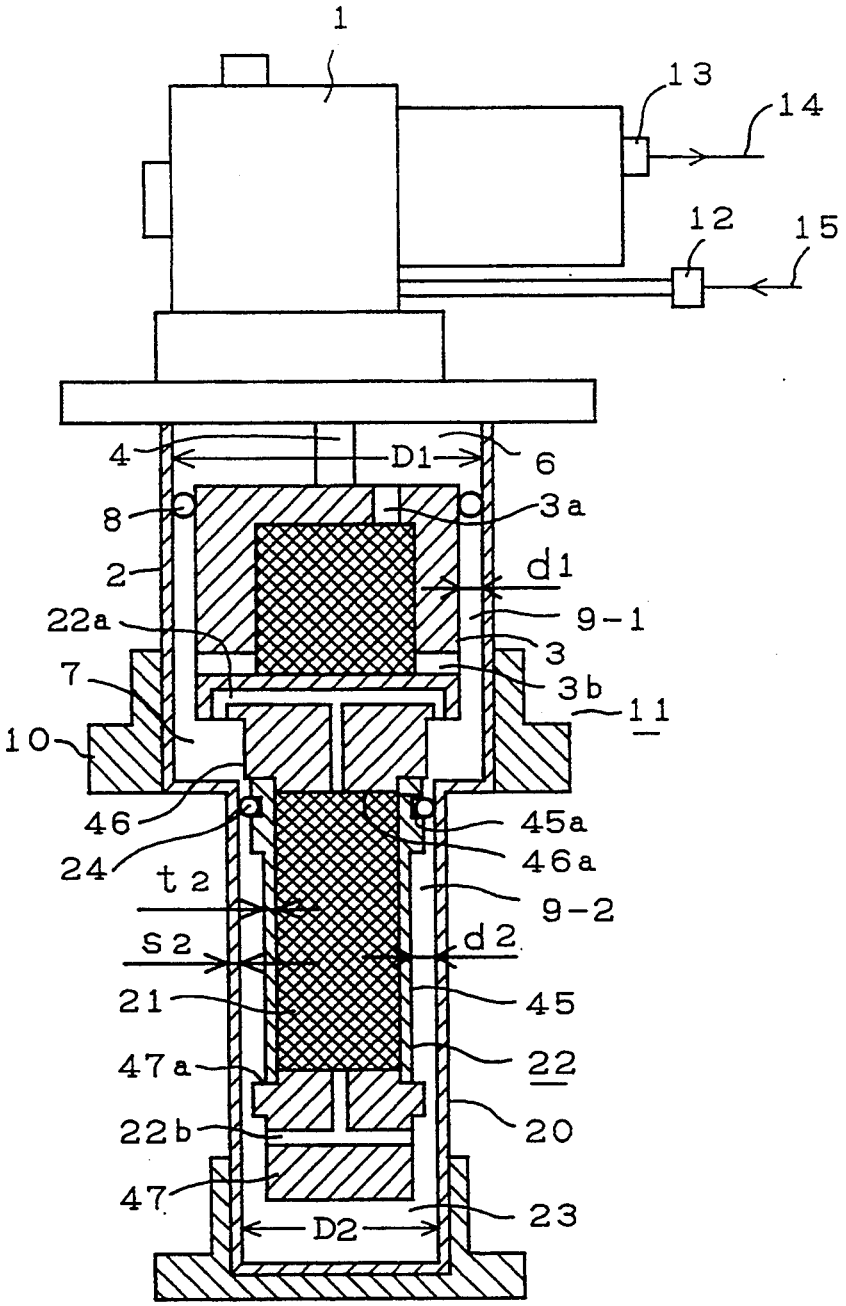
FIG. 24 is a substantial sectional view showing a regenerative refrigerator according to embodiment 23 of the invention.

FIG. 24 is a substantial sectional view of a regenerative refrigerator according to embodiment 23 of the invention. This embodiment is different in the following points from the embodiment shown in FIG. 22. An annular groove 45*a* is formed in the outer peripheral surface of the upper end of a movable member body 45 which is cylindrical and formed of the same stainless steel as that of the cylinder 20, and a piston ring 24 formed of, for example, polytetrafluoroethylene with glass incorporated therein is fitted in the groove 45*a* to isolate second and third closed chambers 7, 23 from each other. Further, a convex portion 46*a* formed at the lower end of a first cylindrical sealing member 46 which is formed using an insulating material such as a phenolic resin or the like as a bad conductor of heat and has an outside diameter larger than that of the movable member body 45, is brought into engagement hermetically with the upper portion of the movable member body. Since the stainless steel which forms the movable member body 45 does not have a water absorbing action, there is no dimensional change caused by the absorption of water during manufacture. Even if the temperature changes, for example the temperature drops, during operation, since the thermal expansion coefficient of the movable member body 45 and that of the cylinder 20 are the same, there is no change in the distance between the bottom of the groove 45*a* and the inner peripheral surface of the cylinder 20, thus affording a high dimensional accuracy. Even in the case where the piston ring 24 is less elastic, the second and third closed chambers 7, 23 are isolated from each other without leakage of gas and hence the refrigerating performance is further improved.

Although in the embodiments described above the present invention was applied to a Gifford McMahon cycle refrigerator (GM refrigerator) with a regenerator disposed in the interior of a movable member which refrigerator is a kind of a regenerative refrigerator, this does not constitute any limitation. For example, the invention is also applicable to GM refrigerator with a regenerator disposed not inside but outside a movable member, as well as such regenerative refrigerators as Stirling refrigerator, Vuillemier refrigerator and Solvay refrigerator. Also in this case there can be expected the same function and effect as in the above embodiments.

According to the present invention, as set forth hereinabove, the convection of gas in the gap between the outer peripheral surface of a movable member and the inner peripheral surface of a cylinder is prevented by setting the size d of the said gap in the range of $1/1000 \leqq d/D \leqq 1/100$ relative to the inside diameter D of the cylinder, or by disposing a convection preventing member in the gap, or by disposing seals on the outer peripheral surfaces of both end portions of the movable member. Therefore, the heat loss caused by the convection of gas is decreased without increase of shuttle loss and without dependence on the mounting angle of the refrigerator, whereby there is obtained a good refrigerating performance.

What is claimed is:

1. A regenerative refrigerator comprising:

a regenerator;

a movable member within a cylinder;

a closed chamber having an internal volume adapted to change with movement of the movable member;

wherein a gas discharged from a compressor is introduced through the regenerator into the closed chamber and is allowed to expand therein, then is discharged again through the same route, and wherein the size, d, of a gap between an inner peripheral surface of said cylinder and an outer peripheral surface of said movable member is set in the range of $1/1000 \leqq d/D \leqq 1/100$ relative to an inside diameter, D, of the cylinder, said range being determined such that temperature rise and shuttle loss within the closed chamber are scarcely dependent on a mounting angle of the regenerative refrigerator.

2. The regenerative refrigerator of claim 1, wherein the size, d, of the gap is set to be 1/600 relative to the inside diameter, D, of the cylinder.

3. A regenerative refrigerator wherein a gas discharged from a compressor is introduced through a regenerator into a closed chamber whose internal volume changes with movement of a movable member disposed within a cylinder, and is allowed to expand therein, then is discharged again through the same route, said regenerative refrigerator, characterized in that the size, d, of a gap between an inner peripheral surface of said cylinder and an outer peripheral surface of said movable member is set in the range of $1/1000 \leqq d/D \leqq 1/100$ relative to an inside diameter, D, of the cylinder, and at least a part of said movable member is formed by a material having a thermal expansion coefficient almost equal to that of the material of said cylinder.

4. A regenerative refrigerator wherein a gas discharged from a compressor is introduced through a regenerator into a closed chamber whose internal volume changes with movement of a movable member disposed within a cylinder, and is allowed to expand therein, then is discharged again through the same route, said regenerative refrigerator, characterized in that the size, d, of a gap between an inner peripheral surface of said cylinder and an outer peripheral surface of said movable member is set in the range of $1/1000 \leqq d/D \leqq 1/100$ relative to an inside diameter, D, of the cylinder, and at least a part of said movable member is formed by a material having a thermal expansion coefficient almost equal to that of the material of said cylinder and having a wall thickness almost equal to or smaller than that of the cylinder.

5. A regenerative refrigerator comprising:

a regenerator;

a movable member within a cylinder;

a closed chamber having an internal volume adapted to change with movement of the movable member;

wherein a gas discharged from a compressor is introduced through the regenerator into the closed chamber and is allowed to expand therein, then is discharged again through the same route, and wherein the size, d, of a gap between an inner peripheral surface of said cylinder and an outer peripheral surface of said movable member is set in the range of $1/1000 \leqq d/D \leqq 1/100$ relative to an inside diameter, D, of the cylinder, said range being determined such that temperature rise and shuttle loss in the closed chamber are scarcely dependent on a mounting angle of the regenerative refrigerator such that convection of the gas in said gap is prevented.

* * * * *